US006491505B1

(12) United States Patent
Hueser et al.

(10) Patent No.: US 6,491,505 B1
(45) Date of Patent: Dec. 10, 2002

(54) ELECTRIC AIR-PUMP APPARATUS FOR MOTOR VEHICLES

(75) Inventors: Theodor Hueser, Geseke; Ralf Mueller, Bad Westernkotten; Udo Schubert, Paderborn; Josef Stuempel, Borchen, all of (DE)

(73) Assignee: Hella KG Hueck & Co., Lippstadt (DE)

( * ) Notice: Subject to any disclaimer, the term of this patent is extended or adjusted under 35 U.S.C. 154(b) by 75 days.

(21) Appl. No.: 09/632,802

(22) Filed: Aug. 4, 2000

(30) Foreign Application Priority Data

Aug. 4, 1999 (DE) ..... 199 36 644

(51) Int. Cl.[7] ..... F04B 17/00; F04B 35/04

(52) U.S. Cl. ..... 417/410.3; 418/259; 418/133; 417/360; 417/312

(58) Field of Search ..... 417/360, 410.3, 417/312; 418/259, 133

(56) References Cited

U.S. PATENT DOCUMENTS 3,829,248 A * 8/1974 Bright et al. ..... 417/410
4,123,201 A * 10/1978 Andriulis ..... 417/204
4,181,472 A * 1/1980 Sharp ..... 417/363

FOREIGN PATENT DOCUMENTS

| | | |
|---|---|---|
| DE | U1-90148886 | 3/1991 |
| DE | C2-4109548 | 10/1991 |
| DE | C2-4239575 | 5/1994 |
| WO | A1-8604393 | 7/1986 |

* cited by examiner

*Primary Examiner*—Charles G. Freay
*Assistant Examiner*—William Rodriguez
(74) *Attorney, Agent, or Firm*—Birch, Stewart, Kolasch & Birch, LLP

(57) ABSTRACT

An electric air-pump apparatus for motor vehicles has a mounting plate to which a housing of an electric motor and a pumping device are attached. A sound absorber is, formed by the mounting plate and a sound-absorber cap attached thereto, with the sound-absorber cap surrounding the pumping device. The sound-absorber cap is positioned on a first side of the mounting plate opposite from a second side of the mounting plate at which the electric motor is to be attached.

15 Claims, 2 Drawing Sheets

ELECTRIC AIR-PUMP APPARATUS FOR MOTOR VEHICLES

BACKGROUND OF THE INVENTION

Figure 1:
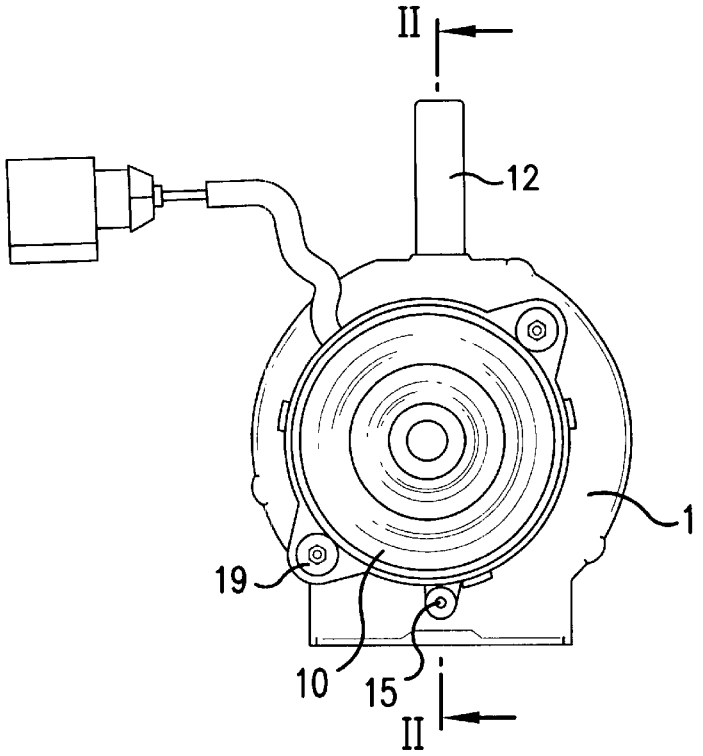

This application claims a priority based on German application 199 36 644.6, filed Aug. 4, 1999, and the contents of that application are incorporated herein by reference.

This invention relates to electric air-pump apparatus for motor vehicles of a type having a mounting plate to which a housing of an electric motor and a pumping device are to be attached, and having a sound absorber formed by the mounting plate and a sound-absorber cap attached thereto.

German patent document (DE 41 09 548 C2) discloses an electric air-pump apparatus of this type. This known electric air-pump apparatus has a sound-absorber cap that surrounds an electric motor, with an annular sound absorbing space thereof surrounding the electric motor. A pumping device thereof is a vane-type pumping device in which the mounting plate forms a base plate of a pump chamber.

There are disadvantages to this known electric air-pump apparatus. By positioning the sound absorber around the electric motor, an outer diameter of this electric air-pump apparatus is large. However, because the electric motor requires so much space, the damping space of the sound absorber must be small.

Because of the nested structure of the electric motor and the sound absorber, it is hardly possible to adjust an electro-pneumatic performance of the electric air-pump apparatus for possible changed requirements because an installation space for the electric motor is limited.

German patent document (DE 42 39 575 C2,) discloses an additional electric air-pump apparatus for motor vehicles, whose sound absorber is positioned on a side of a mounting plate facing away from an electric motor. This sound absorber, however, independently of the electric motor, mounting plate, and pumping device, is arranged as a separate component, which can be snapped subsequently onto a housing of the pumping device. A disadvantage of this solution is that the sound absorber is structured in a costly manner as a separate component.

It is an object of the invention to provide an electric air-pump apparatus for motor vehicles having an uncomplicated and inexpensive structure that requires little installation room.

SUMMARY OF THE INVENTION

According to principles of this invention, a sound-absorber cap of an electric air-pump apparatus surrounds a pumping. device and the sound-absorber cap is placed on a side of a mounting plate facing away from an electric motor.

By arranging the sound-absorber cap in the manner of this invention, an outer diameter of an electric air-pump apparatus of the invention can be significantly reduced. Additionally, one electric motor can easily be replaced by another motor having different outside dimensions, without requiring changes to the sound-absorber cap for that purpose.

Because in this invention the sound-absorber cap surrounds the pumping device, no prearranging of leads or chambers between the pumping device and the sound-absorber cap is necessary for creating the sound absorber. This measure also ultimately saves on installation space, and results in a damping space of the sound absorber being large in comparison to those of the prior art, even though outer dimensions of the sound-absorber cap are small. This leads to very effective sound absorption of intake and exhaust noises.

The solution of the invention ultimately can be achieved with less complicated and less costly measures relative to the prior art, because the sound absorber is formed solely by the mounting plate and the sound-absorber cap structured in a very uncomplicated shape, which does not require any sort of internal chambers or channels. The electric air-pump apparatus according to the invention can be installed with very uncomplicated measures because the sound-absorber cap is simply placed over the pumping device, after the pumping device is mounted on the mounting plate, and fastened to the mounting plate.

Advantageous embodiments and further developments of the invention are also possible.

Thus the electric air-pump apparatus can advantageously include a suction pumping device, with which a vacuum is generated. Particularly in this case, the mounting plate can have an intake column and/or an outlet channel for the conveyed air, so that the sound-absorber cap does not need to have any holes or tube-like connecting parts for creating such channels.

In this connection, the mounting plate can have a recess in an area of the outlet channel, which in conjunction with a flange edge of the sound-absorber cap, forms a labyrinth for preventing moisture, for example in the form of water spray, from entering into the damping space of the sound absorber in an unwanted manner. In order to remove condensation water from the damping space, particularly if condensation forms in the damping space of the sound absorber, it is especially advantageous for the outlet channel to be positioned below the pumping device and thereby open into the sound absorber at the lowest point of the sound absorber.

As an additional functional characteristic. the mounting plate can, in a particularly advantageous manner, have a fastening flange that makes it possible to attach the entire electric air-pump apparatus to a support. In this way, suitable fastening parts are not required in the area of the sound-absorber cap. Similarly, in a particularly advantageous manner, the mounting plate has a seat for a motor shaft bearing and/or a seat for a brush holder of the electric motor, in order to assume some functions of the motor housing of the electric motor. This simplifies construction of the remainder of the electric motor, and also results in a reduction of costs and expense of construction of the electric air-pump apparatus of this invention.

In a particularly advantageous manner, the mounting plate can be die-cast of metal, particularly aluminum, whereby, in an especially advantageous manner, the functional parts described above, the intake column, outlet channel, recess, mounting plate, and seats for the motor shaft bearing and brush holder, can be formed as a single part with the mounting plate. This also contributes to simplification of the electric air-pump apparatus and, thus, to a reduction in manufacturing costs.

Finally, in a particularly advantageous manner, the pumping device may be a vane-type pumping device, with the individual pump parts, base plate, rotor, ring, and cover, being made in a known manner of a carbon-plastic compound, which has the particular advantage of high abrasion resistance and low friction. The functional parts of the pumping device, then, are structured independently from the mounting plate so that a service life of the pumping device can be increased significantly over those of pumping devices of such electric air-pump apparatus in the prior art.

BRIEF DESCRIPTIONS OF THE DRAWINGS

An Embodiment of an electric air-pump apparatus of the invention is presented in the drawings and will be explained in further detail with reference to the drawings. The described and drawn features can be used, individually or in preferred combinations, in other embodiments of the invention. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Figure 2:
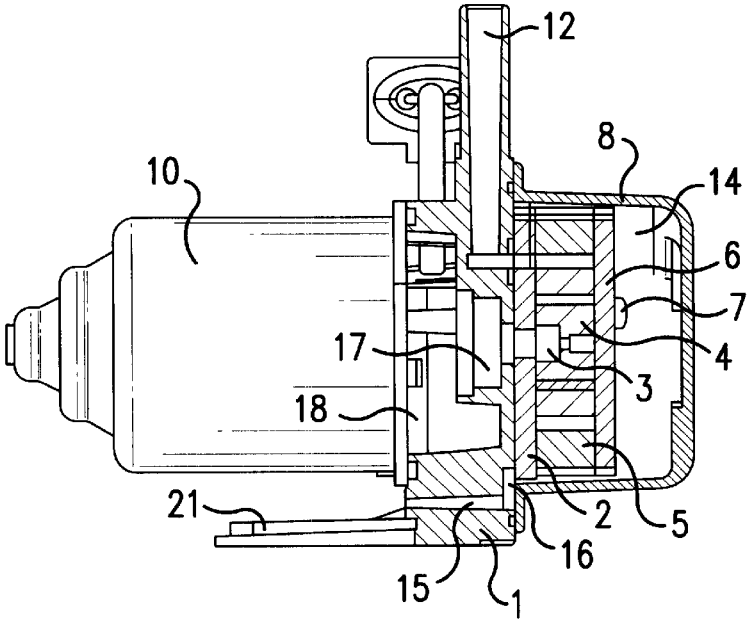
Figure 3:
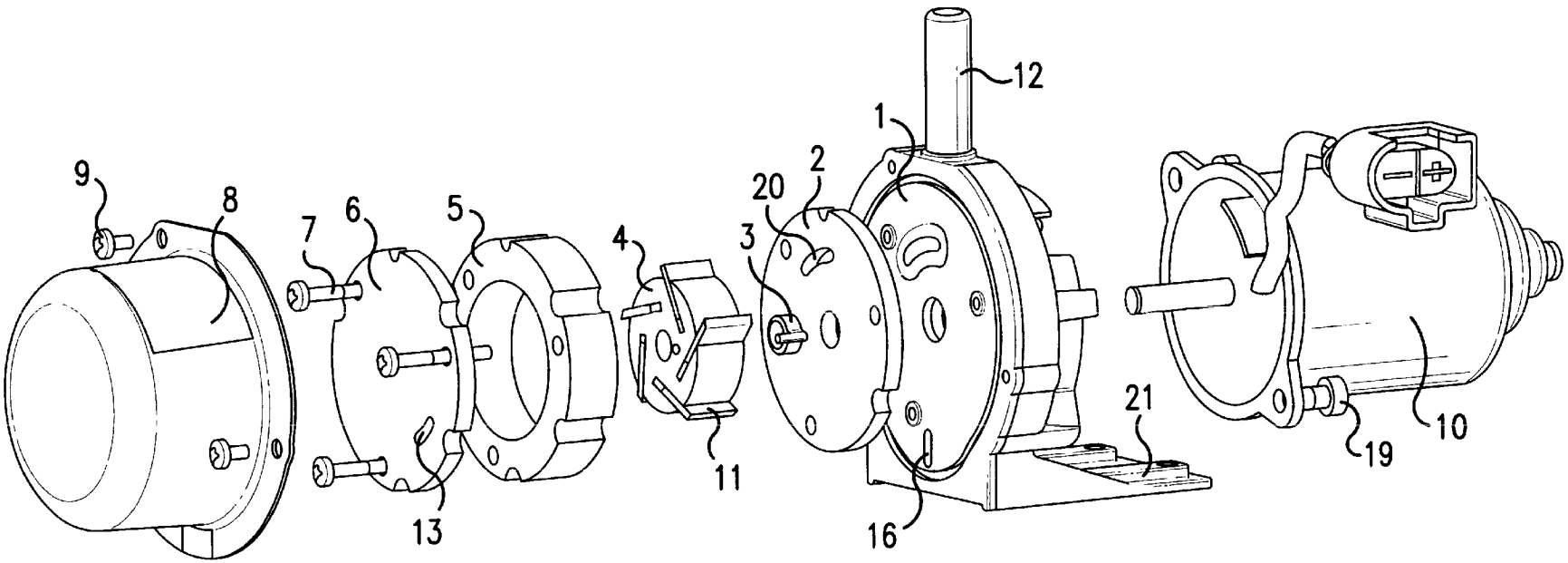

FIG. 1 is an end view of an electric air-pump apparatus of this invention, from a motor end, FIG. 2 is a partially sectional side view of the electric air-pump apparatus, with the partial section taken on line II—II in FIG. 1, and FIG. 3 is an exploded view of the electric pump of FIG. 1, showing the functionally important parts in the context of this invention.

DETAILED DESCRIPTION OF THE INVENTION

In FIG. 1, an electric air-pump apparatus has a mounting plate 1, to which a pot-shaped housing 10 of an electric motor is attached by fastening screws 19. Additionally, FIG. 1 shows an intake column 12 for the electric air-pump apparatus, which is structured to include a suction pumping device for creating a vacuum. Finally, FIG. 1 also shows an outlet channel 15 through which air taken in via the intake column 12 is expelled after passing through the pumping device.

The same or similarly-functioning pumping device parts shown in FIG. 2, are designated with the same reference numbers as in FIG. 1. It is clear in FIG. 2 that the intake column 12 has a channel that is angled to the right in an area of the pumping device, and opens through a base plate 2 into a pump chamber of the pumping device. This pump chamber of the pumping device is enclosed by the base plate 2, a pump rotor 4, a pump ring 5, and a cover 6 of the pump chamber.

The pump rotor 4, in this regard, is connected via a driver 3 with a motor shaft of the electric motor, which is enclosed by the pot-shaped housing 10. The entire pumping device, comprising the parts specified above, is connected with the mounting plate I by screws 7 so that the individual pump parts are clamped tightly between the cover 6 and the mounting plate 1.

Exhaust air of the vacuum pumping device flows into a damping space of a sound absorber 14 formed by the mounting plate 1 and a sound-absorber cap 8 attached thereto that surrounds the pumping device. After flowing through the damping space of the sound absorber, the exhaust air exits the sound absorber through the outlet channel 15, which is positioned below the pumping device and has a recess 16 which, in conjunction with a flange edge of the sound-absorber cap 8, forms a labyrinth. This labyrinth serves to hinder entry of water spray into the damping space of the sound absorber 14, and, on the other hand, is positioned so that any condensation moisture that forms in the damping space of the sound absorber 14 is expelled from the damping space by the pumped air.

In addition to the intake column 12 and the outlet channel 15 with the recess 16 and the threaded holes for the various fastening screws, the mounting plate 1 has a fastening flange 21 for fastening the entire electric air-pump apparatus onto a base support. Moreover, a seat 17 for a pump-end motor-shaft bearing and a it seat 18 for a brush holder of the pump motor are provided as additional functional parts of the mounting plate 1, so that the pump-end housing part of the electric motor may be omitted, and its function may be fully assumed by the mounting plate 1 both electrically and mechanically.

In FIG. 3, the same or similarly functioning pump parts are shown as in FIGS. 1 and 2, marked with the same reference numbers as in FIGS. 1 and 2. FIG. 3 clearly shows the structural mounting possibilities of the electric air-pump apparatus, wherein, additionally with respect to FIGS. 1 and 2, the position and arrangement of an outlet opening 13 of the pumping device can be seen in the cover 6 of the pumping device and an intake opening 20 of the pumping device can be seen in the. base plate 2 of the pumping device. This makes it clear that both the position and the shape of the channel of the intake column 12 are adapted to the position and shape of the intake opening 20. Air flowing out through the outlet opening 13 of the cover 6, by contrast, can, expand throughout the entire damping space of the sound absorber 14 inside the sound-absorber cap 8, and then flow through the outlet channel 15 to the outside via the recess 16. The entire structure of the electric air-pump apparatus is quite uncomplicated and inexpensive, and makes possible use of different pumping devices inside the sound-absorber cap 8 as well as different sizes of electric motors for the electric air-pump apparatus.

We claim:

1. Electric air-pump apparatus for motor vehicles comprising a pumping device for being driven by an electric motor, said electric air-pump apparatus further including a mounting plate (1) for being attached to a housing (10), of the electric motor and to the pumping device and a sound-absorber cap (8) attached to the mounting plate (1) for forming a sound, absorber (14) therewith, wherein the sound-absorber cap (8) surrounds the pumping device and is arranged on a first side of the mounting plate opposite a second side of the mounting plate (1) to which said housing of the electric motor is to be attached, and wherein the formed sound absorber utilizes substantially the entire volume defined by the mounted sound absorber cap, as an air damping space for absorbing sound.

2. An electric air-pump apparatus as in claim 1, wherein the pumping device is an air pumping device and wherein the air pumping device is a suction pumping device operating according to a positive displacement principle.

3. Electric air-pump apparatus as in claim 1, wherein the pumping device is an air pumping device and wherein the mounting plate (1) has at least one of an intake column (12) and an outlet channel (15) for driven air.

4. Electric air-pump apparatus as in claim 3, wherein the mounting plate (1) has a recess (16) to form said outlet channel (15) which, in conjunction with a flange edge of the sound-absorber cap (8), forms the outlet channel as a labyrinth.

5. Electric air-pump apparatus as in claim 3, wherein said mounting plate has said outlet channel and wherein the outlet channel (15) is positioned below the pumping device, when said mounting plate is in an installed position.

6. Electric air-pump apparatus as in claim 1, wherein the mounting plate (1) has a fastening flange (21) for the air pumping device.

7. Electric air-pump apparatus as in claim 1, wherein the mounting plate (1) has at least one of a seat for holding a motor shaft bearing (17) and a seat for holding a brush holder (18) of the pump motor.

8. Electric air-pump apparatus as in claim 1, wherein the mounting plate (1) is die-cast of metal.

9. Electric air-pump apparatus as in claim 1, wherein the sound-absorber cap (8) is of metal.

10. Electric air-pump apparatus as in claim 9, wherein the sound-absorber cap (8) is of light metal die casting.

11. Electric air-pump apparatus as in claim 9, wherein the sound-absorber cap (8) is a deep-drawn part.

12. Electric air-pump apparatus as in claim 1, wherein the pumping device is an impeller pumping device comprising a base plate (2), a pump rotor (4), a pump ring (5), and a cover (6).

13. Electric air pump apparatus as: in claim 8, wherein the mounting plate is aluminum.

14. Electric air-pump apparatus for motor vehicles comprising a pumping device for being driven by an electric motor, said electric air-pump apparatus further including a mounting plate (1) for being attached to a housing (10) of the electric motor and to the pumping device and a sound-absorber cap (8) attached to the mounting plate (1) for forming a sound:absorber (14) therewith;

wherein the sound-absorber cap (8) surrounds the pumping device and is arranged on a first side of the mounting plate opposite a second side of the mounting plate (1) to which said housing of the electric motor is to be attached;

wherein the pumping device is an air pumping device and wherein the mounting plate (1) has ant least one of an intake column (12) and an outlet channel (15) for driven air; and wherein the mounting plate (1) has a recess (16) to form said outlet channel (15) which, in conjunction with a flange edge of the sound-absorber cap (8), forms the outlet channel as a labyrinth.

15. Electric air-pump apparatus for motor vehicles comprising a pumping device for being driven by an electric motor, said electric air-pump apparatus further including a mounting plate (1) for being attached to a housing (10) of the electric motor and to the pumping device and a sound-absorber cap (8) attached to the mounting plate (1) for forming a sound absorber (14) therewith;

wherein the sound-absorber cap (8) surrounds the pumping device and is arranged on a first side of the mounting plate opposite a second side of the mounting plate (1) to which said housing of the electric motor is to be attached;

wherein the pumping device is an air pumping device and wherein the mounting plate (1) has at least one of an intake column (12) and an outlet channel (15) for driven air; and wherein said mounting plate has said outlet channel and wherein the outlet channel (15) is positioned below the pumping device.

* * * * *